US010533512B2

(12) United States Patent
Oohata

(10) Patent No.: US 10,533,512 B2
(45) Date of Patent: Jan. 14, 2020

(54) CONTROL DEVICE FOR INTERNAL COMBUSTION ENGINE

(71) Applicant: HITACHI AUTOMOTIVE SYSTEMS, LTD., Ibaraki (JP)

(72) Inventor: Eiichirou Oohata, Hitachinaka (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 0 days.

(21) Appl. No.: 15/770,974

(22) PCT Filed: Oct. 13, 2016

(86) PCT No.: PCT/JP2016/080331

§ 371 (c)(1),
(2) Date: Apr. 25, 2018

(87) PCT Pub. No.: WO2017/073340

PCT Pub. Date: May 4, 2017

(65) Prior Publication Data

US 2018/0320622 A1 Nov. 8, 2018

(30) Foreign Application Priority Data

Oct. 27, 2015 (JP) ..... 2015-210303

(51) Int. Cl.
*F02D 41/24* (2006.01)
*F02D 41/00* (2006.01)

(52) U.S. Cl.
CPC ..... *F02D 41/2451* (2013.01); *F02D 41/009* (2013.01); *F02D 41/2412* (2013.01);
(Continued)

(58) Field of Classification Search
CPC ..... F02D 35/02; F02D 35/024; F02D 41/00; F02D 41/009; F02D 41/24;
(Continued)

(56) References Cited

U.S. PATENT DOCUMENTS

2003/0167118 A1 9/2003 Rizzoni et al.
2009/0024298 A1 1/2009 Caretta
(Continued)

FOREIGN PATENT DOCUMENTS

DE 102013200542 A1 7/2014
JP 09-228864 A 9/1997
(Continued)

OTHER PUBLICATIONS

International Search Report dated Jan. 17, 2017 of International Application No. PCT/JP2016/080331.
(Continued)

*Primary Examiner* — John Kwon
*Assistant Examiner* — Johnny H Hoang
(74) *Attorney, Agent, or Firm* — Volpe and Koenig, P.C.

(57) ABSTRACT

A combustion pressure detection method and a combustion pressure detection apparatus of an internal combustion engine that can detect combustion pressure by using a crank angle sensor in an accurate and easy way.
A relationship between a crank angle sensor signal and a combustion pressure signal is previously recorded. As a result, even if the combustion pressure sensor fails, the combustion pressure is detected by collating the crank angle sensor signal with the relationship.

6 Claims, 8 Drawing Sheets

(52) U.S. Cl.
CPC .. *F02D 2200/024* (2013.01); *F02D 2200/101* (2013.01); *F02D 2200/1002* (2013.01)

(58) Field of Classification Search
CPC ..... F02D 41/2412; F02D 41/2451; F02D 2200/024; F02D 2200/101; F02D 2200/1002
USPC ..... 701/102–105
See application file for complete search history.

(56) References Cited

U.S. PATENT DOCUMENTS

2012/0042850 A1* 2/2012 Haskara ..... F02D 41/0072 123/305
2012/0216777 A1* 8/2012 Moonjelly ..... F02D 41/0085 123/435
2013/0197781 A1* 8/2013 Shin ..... F02D 41/2438 701/103
2013/0311064 A1* 11/2013 Suzuki ..... F02D 35/023 701/103
2014/0074378 A1* 3/2014 Iwai ..... F02D 43/04 701/104
2014/0260574 A1* 9/2014 Sasaki ..... F02D 41/009 73/114.16
2015/0219026 A1* 8/2015 Urano ..... F02D 35/023 123/48 B
2015/0226642 A1* 8/2015 Urano ..... F02D 41/009 73/114.02
2015/0275810 A1 10/2015 Tanaka et al.

FOREIGN PATENT DOCUMENTS

JP 2006-336498 A 12/2006
JP 2010-059883 A 3/2010
JP 2010-265877 A 11/2010
JP 2013-133734 A 7/2013
JP 2015-183675 A 10/2015

OTHER PUBLICATIONS

Japanese Office Action dated Aug. 28, 2018 for the Japanese Patent Application No. 2017-547725.
Extended European Search Report dated May 22, 2019 for the European Patent Application No. 16859575.9.

* cited by examiner

CONTROL DEVICE FOR INTERNAL COMBUSTION ENGINE

TECHNICAL FIELD

The present invention relates to a combustion pressure detection method and a combustion pressure detection apparatus of an internal combustion engine for detecting a combustion pressure (in-cylinder pressure) in a cylinder of the internal combustion engine. More particularly, the present invention relates to a combustion pressure detection method and a combustion pressure detection apparatus of an internal combustion engine for detecting combustion pressure using a crank angle sensor.

BACKGROUND ART

Recently, to reduce fuel consumption and harmful exhaust gas components, various control methods have been proposed for purposes such as improving the control accuracy of a fuel injection amount and fuel injection timing and improving the control accuracy of ignition timing. Furthermore, for example, approach using a new combustion method such as a method using spark ignition and compression ignition has also been taken. What is requested for further improvement of the control accuracy and proposing a new control method is to accurately grasp a combustion state of an air-fuel mixture made of a fuel and air in a cylinder. Therefore, to accurately grasp the combustion state, it is desirable to detect combustion pressure caused by combustion in the cylinder.

For this reason, there is generally proposed a method in which a hole communicating with a combustion chamber is formed in a cylinder block or a cylinder head, and combustion pressure in a cylinder is applied to a pressure sensing element via the hole to detect the combustion pressure. In this method, an air column vibration that occurs in the hole is an error cause. To suppress the air column vibration that occurs in the hole, it is necessary to shorten the hole. As a result, the pressure sensing element is located near the combustion chamber. Since a thermal shock is large near the combustion chamber, a load on the pressure detection element is large. This is a cause of a failure such as a decrease in sensitivity and disconnection and becomes a technical problem.

Under such circumstances, for example, JP 2006-336498 A (PTL 1) has proposed that a combustion state is detected using an existing crank angle sensor and applied for controlling an internal combustion engine. It is generally known to use a crank angle detection sensor for detecting a crank angular velocity of the internal combustion engine as a means for grasping the combustion state in the cylinder of the internal combustion engine. This crank angle sensor is for detecting the crank angular velocity of the crankshaft of the internal combustion engine, but indirectly detects the combustion state in the combustion chamber and detects a change in the angular velocity of the crankshaft due to a change in the combustion state.

Then, PTL 1 proposes to correct a variation in the cycle of the angle signal of the crank angle sensor and detect the combustion state by properly analyzing the cycle of the angle signal of the crank angle sensor.

CITATION LIST

Patent Literature

PTL 1: JP 2006-336498 A

SUMMARY OF INVENTION

Technical Problem

In the combustion state detection method described in PTL 1, a variation in the mechanical cycle of the detector is corrected. However, depending on the operating condition of the internal combustion engine, excessive torsional vibrations occur due to matching of natural vibration frequency of the crankshaft and engine vibration. At present, it is impossible to solve the variation in the cycle due to the torsional vibrations by contents described in PTL 1. Therefore, a detection method and a detection device capable of accurately detecting the combustion pressure even in a case where torsional vibrations occur in the crankshaft are strongly required.

It is an object of the present invention to provide a combustion pressure detection method and a combustion pressure detection apparatus of an internal combustion engine that can detect combustion pressure by using a crank angle sensor in an accurate and easy way.

Solution to Problem

To solve the above-described problem, the present invention includes a memory that records a relationship between a reference crank sensor signal and in-cylinder pressure of a predetermined cylinder and a processor that obtains in-cylinder pressure of the cylinder by collating a detected signal of the crank angle sensor with the relationship between the crank sensor signal and the in-cylinder pressure of the predetermined cylinder that is stored in the memory.

Advantageous Effects of Invention

According to the present invention, the combustion pressure can be detected by using the crank angle sensor in an accurate and easy way. Other configurations, operations and effects of the present invention will be described in detail in the following embodiment.

FIG. **6*a*** is a descriptive diagram for describing the pitch error for describing the concept of the present invention.

FIG. **6*b*** is a descriptive diagram for describing a cycle of a crank angle sensor output signal for describing the concept of the present invention.

Figure 7:
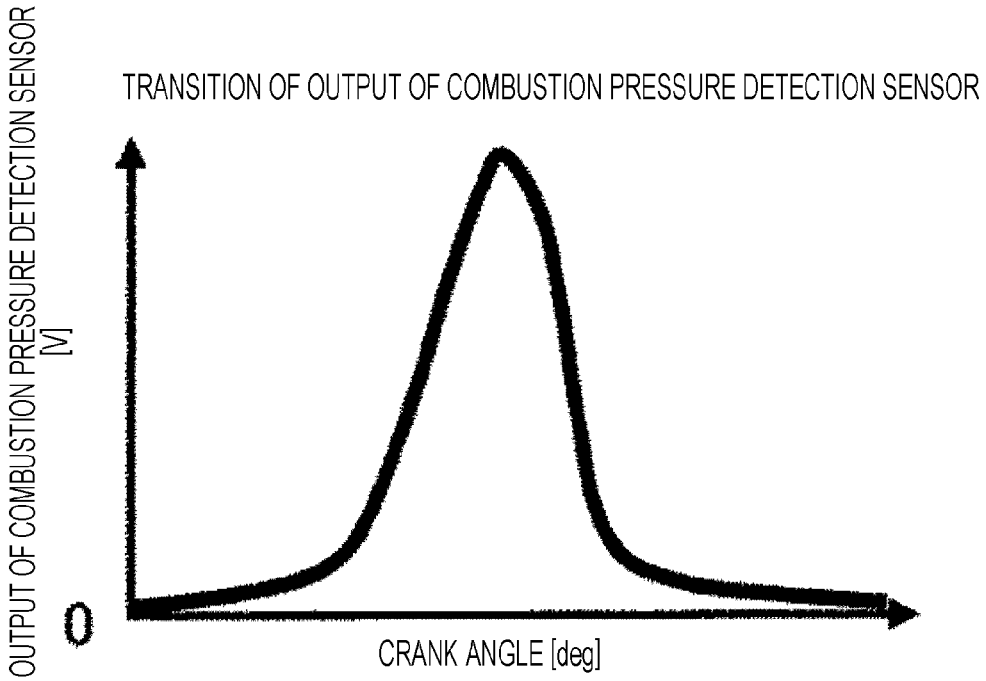

FIG. 7 is a descriptive diagram for describing transition of output of a combustion pressure detection sensor for describing the concept of the present invention.

Figure 8:
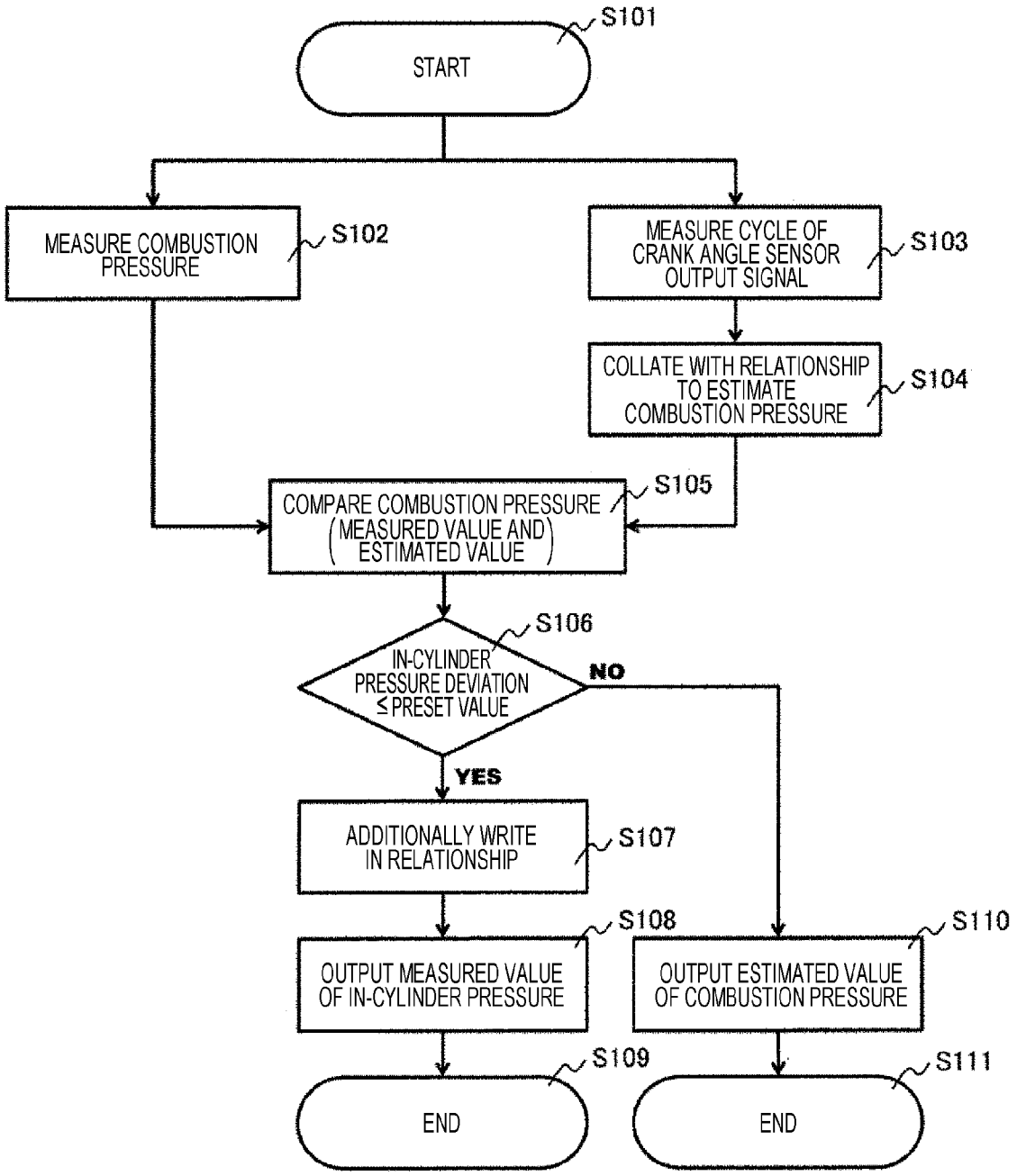

FIG. 8 is a flowchart for describing the embodiment of the present invention.

Figure 9:
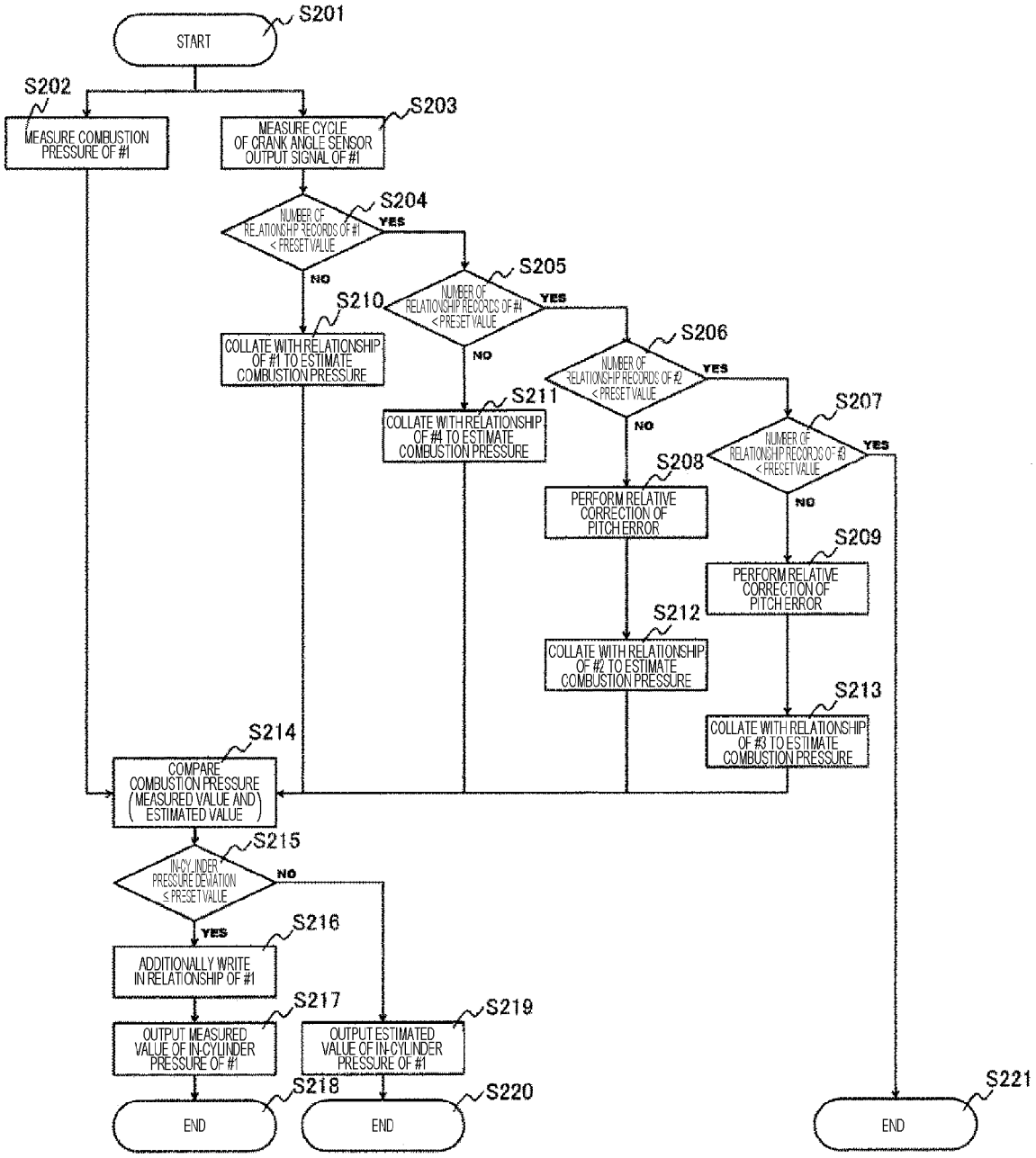

FIG. 9 is a flowchart for describing the embodiment of the present invention.

DESCRIPTION OF EMBODIMENTS

Hereinafter, an embodiment of the present invention will be described in detail with reference to the drawings. However, the present invention is not limited to the following embodiments, and includes, in its scope, various modifications and application examples within the technical concept of the present invention.

Embodiment

Figure 1:
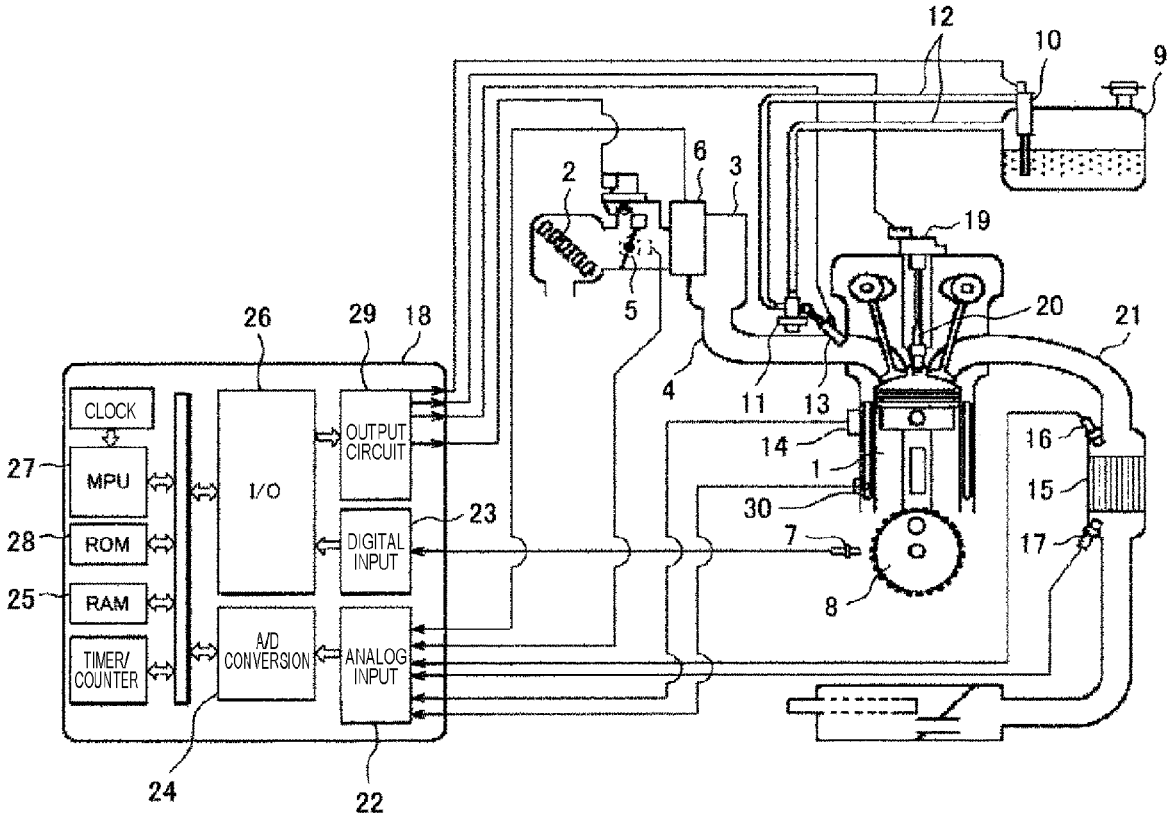
FIG. 1 is a configuration diagram illustrating a configuration of a control system of an internal combustion engine to which the present invention is applied.

FIG. 1 is a view of a control system of an internal combustion engine to which the present invention is applied. In the internal combustion engine 1 including multiple cylinders (four cylinders in this case), the air from the outside passes through an air cleaner 2 and flows into the cylinder via an intake pipe 3 and a collector 4. An inflow air amount is adjusted by a throttle valve 5, and the adjusted inflow air amount is detected by a flow rate sensor 6. In addition, an intake air temperature is detected by an intake air temperature sensor (not illustrated). The throttle valve 5 may be an electronic throttle valve driven by an electric motor, and recently this electronic throttle valve is mainstream.

In a crank angle sensor 7, a signal for each predetermined rotation angle of a crankshaft, for example, for each 10°, and a signal for each combustion cycle are output by a ring gear 8. A water temperature sensor 30 detects the cooling water temperature of the internal combustion engine, and an accelerator depression amount sensor (not illustrated) detects the depression amount of an accelerator, thereby detecting the required torque of a driver. A control apparatus 18 converts the output of the accelerator depression amount sensor into the opening degree of the electronic throttle valve 5, and the electronic throttle valve 5 is controlled on the basis of the opening degree.

The present embodiment is configured to perform acceleration operation determination by using the signal of the accelerator depression amount sensor. Since the accelerator depression amount sensor can reflect the intention of the driver's driving operation at the earliest, it is desirable to use the accelerator depression amount sensor for determining the acceleration operation.

A fuel in a fuel tank 9 is sucked and pressurized by a fuel pump 10 and then guided to the fuel inlet of a fuel injection valve 13 through a fuel pipe 12 including a pressure regulator 11, and excess fuel is returned to the fuel tank 9.

To grasp a combustion state of the internal combustion engine, a combustion pressure sensor 14 that measures the combustion pressure of the internal combustion engine is provided near the combustion chamber of the internal combustion engine 1 (normally providing a communication hole in a cylinder head). The combustion pressure sensor 14 is a piezoelectric pressure sensor or a gauge type combustion pressure sensor and is capable of detecting combustion pressure over a wide temperature range. In a case where a signal output from a detection element of the combustion pressure sensor is weak, an amplifier that amplifies the signal may be attached.

A three-way catalyst 15 is attached to an exhaust system, and exhaust gas is purified by the three-way catalyst 15 and then discharged to the air. An upstream-side air-fuel ratio sensor 16 is provided upstream of the three-way catalyst 15. In the present embodiment, an air-fuel ratio sensor 16 that outputs a continuous detection signal according to the air-fuel ratio is used as the air-fuel ratio sensor 16 on the upstream side. In addition, a downstream air-fuel ratio sensor 17 is provided downstream of the three-way catalyst 15. In the present embodiment, an O2 sensor 17 that outputs a switch-like detection signal near at a theoretical air fuel ratio as the downstream air-fuel ratio sensor 17.

Each signal of a throttle opening degree sensor attached to the throttle valve 5, the flow rate sensor 6, the crank angle sensor 7, the accelerator depression amount sensor, the intake air temperature sensor, the water temperature sensor 30, a vibration detection sensor 14 and the like is sent to the control apparatus 18, the operating state of the internal combustion engine is detected from these sensor outputs, and the main operation amounts of the internal combustion engine such as the air amount, a fuel injection amount, ignition timing are appropriately calculated.

A target air amount calculated in the control apparatus 18 is converted from a target throttle opening degree to an electronic throttle driving signal and sent to an electric motor that drives the throttle valve 5. In addition, a fuel injection amount calculated in the control apparatus 18 is converted into a valve opening pulse signal and sent to the fuel injection valve 13. Furthermore, the ignition timing calculated by the control apparatus 18 is sent to an ignition coil 19 as an ignition signal converted into an energization start angle and a conduction angle, and a fire is ignited by an ignition plug 20.

Then, the fuel injected from the fuel injection valve 13 is mixed with the air from an intake manifold and flows into a cylinder of the internal combustion engine 1 to form an air-fuel mixture. The air-fuel mixture burns and explodes due to a spark generated at a predetermined ignition timing by the ignition plug 20 and pushes down a piston by the combustion pressure thereof to become the power of the internal combustion engine. Exhaust after the explosion is sent to the three-way catalyst 15 via an exhaust pipe 21.

The upstream-side air-fuel ratio sensor 16 provided upstream of the three-way catalyst 15 detects the air-fuel ratio of the exhaust gas before flowing into the catalyst, and the O2 sensor 17 provided downstream of the three-way catalyst 15 detects the air-fuel ratio of exhaust gas cleaned by the catalyst. The air-fuel ratio detected by the air-fuel ratio sensor 16 is used to correct the amount of fuel injected from the fuel injection valve 13.

In the control apparatus 18, each sensor output value of the air flow rate sensor 6, the air-fuel ratio sensor 16 on the upstream side of the catalyst, the O2 sensor 17 on the downstream side of the catalyst, the accelerator depression amount sensor, the water temperature sensor 30, the throttle opening degree sensor, the intake air temperature sensor, the combustion pressure sensor 14, and the like is input to an analog input unit 22. In addition, a discrete signal such as an angle signal of the crank angle sensor 7 is input to a digital input unit 23.

A sensor signal input to the analog input unit 22 is subjected to signal processing such as noise removal. Then, the sensor signal is converted from analog to digital (A/D) by an A/D converter 24 and stored in a random-access memory (RAM) 25. Similarly, the angle signal input to the digital input unit 23 is also stored in the RAM 25 via an input/output port 26. The detection signal stored in the RAM 25 is subjected to calculation processing in a microprocessor unit (MPU) 27. The MPU 27 executes calculations for generating various control signals.

A control program describing the contents of the calculation processing is previously written in a read-only memory (ROM) 28. A control value representing the operation amount of each actuator that is calculated by the MPU 27 according to the control program is stored in the RAM 25 and then sent to the input/output port 26.

An operation signal of the ignition plug 20 is sent to an ignition control unit in an output circuit 29, and an on-off signal that is turned off when the on-off signal flows in a primary-side coil and is turned off when the on-off signal does not flow in the primary-side coil is set. The ignition signal set in the ignition control unit is amplified by the ignition coil 19 into energy necessary for igniting the ignition plug 20 and supplied to the ignition plug 20. In addition, a drive signal of the fuel injection valve 13 is sent to the fuel control unit in the output circuit 29, and an on-off signal that is turned on when a valve is opened and is turned off when the valve is closed is set. An injection signal set in the fuel control unit is sent to the fuel injection valve 13. Other control devices are also driven in a similar way.

Since the control system as described above is basically well known, further description thereof will be omitted. However, among the control functions executed by the control apparatus 18 illustrated in FIG. 1, a control block that executes an ignition control function and a fuel control function is illustrated in FIG. 2.

Figure 2:
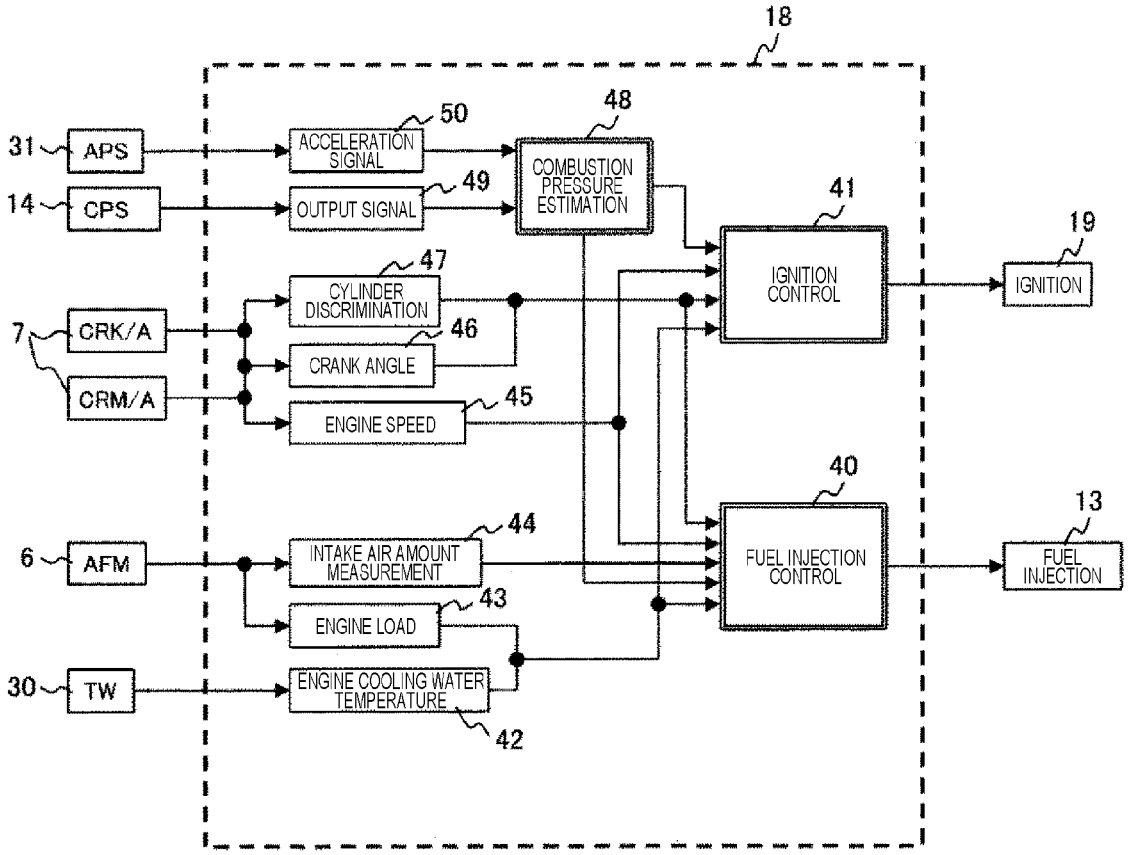
FIG. 2 is a diagram of a control block that executes a fuel control function and an ignition control function that are control functions executed by the control apparatus illustrated in FIG. 1.

In FIG. 2, the control apparatus 18 is provided with a fuel injection control block 40 and an ignition control block 41. These blocks actually represent functions executed by the MPU 27 provided in the control apparatus 18.

In the fuel injection control block 40, each piece of information from a cooling water temperature information generating unit 42, a load information generating unit 43, an air amount information generating unit 44, a rotation speed information generating unit 45, a crank angle information generating unit 46, and a cylinder discrimination information generating unit 47 is input. On the basis of a predetermined arithmetic expression from these pieces of input information, the fuel injection control block 40 calculates an injection amount of the fuel injected from the fuel injection valve 13 and injection timing thereof, and the fuel is injected from the fuel injection valve 13 to the intake manifold.

In the ignition timing control block 41, each piece of information from the cooling water temperature information generating unit 42, the load information generating unit 43, the rotation speed information generating unit 45, the crank angle information generating unit 46, and the cylinder discrimination information generating unit 47 is input. On the basis of a predetermined arithmetic expression from these pieces of input information, the ignition timing control block 41 calculates timing at which the primary current of the ignition coil 19 flows (energization start timing), an energization amount (conduction angle) of the ignition coil 19, and ignition timing at which the primary current is interrupted. The primary current of the ignition coil 19 is controlled according to the energization start timing, the energization angle, and the ignition timing.

Furthermore, combustion pressure information and knock information from a combustion pressure estimation calculation block 48, which is a feature of the present embodiment, are input in the ignition timing control block 41, whereby, for example, minimum sparkadvance for best torque (MBT) control by a combustion pressure signal and delay angle control when knock occurs are executed. In the present embodiment, information from at least a vibration detection sensor output information generation unit 49 is input to the combustion pressure estimation calculation block 48, and on the basis of these inputs, the combustion pressure estimation calculation block 48 estimates the combustion pressure and detect an occurrence of knock. Note that in addition to the information, information from an acceleration state information generating unit 50 is also input. An ignition timing correction value by the MBT control and a delay angle correction value when knock occurs are calculated by the ignition timing control block 41.

As described above, since the detection accuracy and durability of the combustion pressure sensor are antinomic to each other, it is necessary to assume responses at the time of a failure, and it is necessary to provide an alternative means at the time of the failure.

To respond to such requests, according to the present invention, a relationship between the crank angle sensor signal and the combustion pressure signal is previously recorded. As a result, even if the combustion pressure sensor fails, the combustion pressure is detected by collating the crank angle sensor signal with the relationship. Hereinafter, an embodiment according to the present invention will be described in detail. First, a basic concept of the present embodiment will be described.

Figure 3:
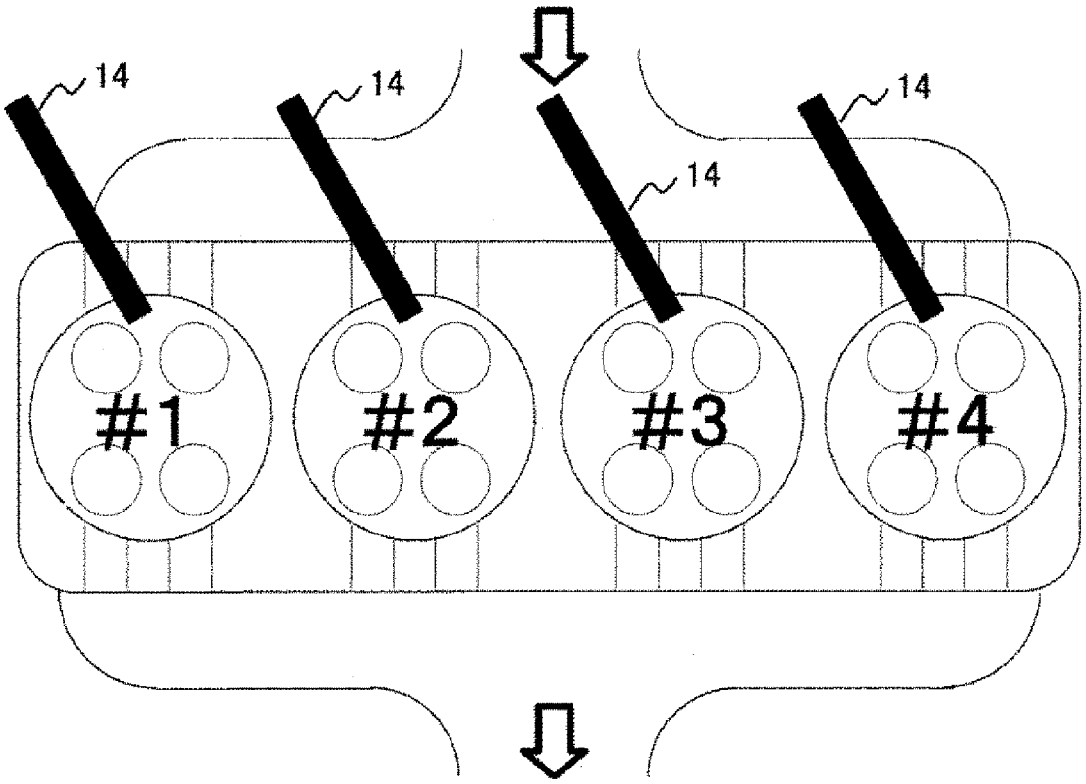
FIG. 3 is a diagram illustrating a cylinder arrangement configuration of an internal combustion engine for describing an embodiment of the present invention.

FIG. 3 is an exemplary cylinder arrangement viewed from the vertical direction of cylinders of a multi-cylinder internal combustion engine. Each cylinder is arranged in series, and the cylinder number of each of four cylinders is #1 to #4. The combustion pressure sensor 14 is attached to each cylinder.

Figure 4:
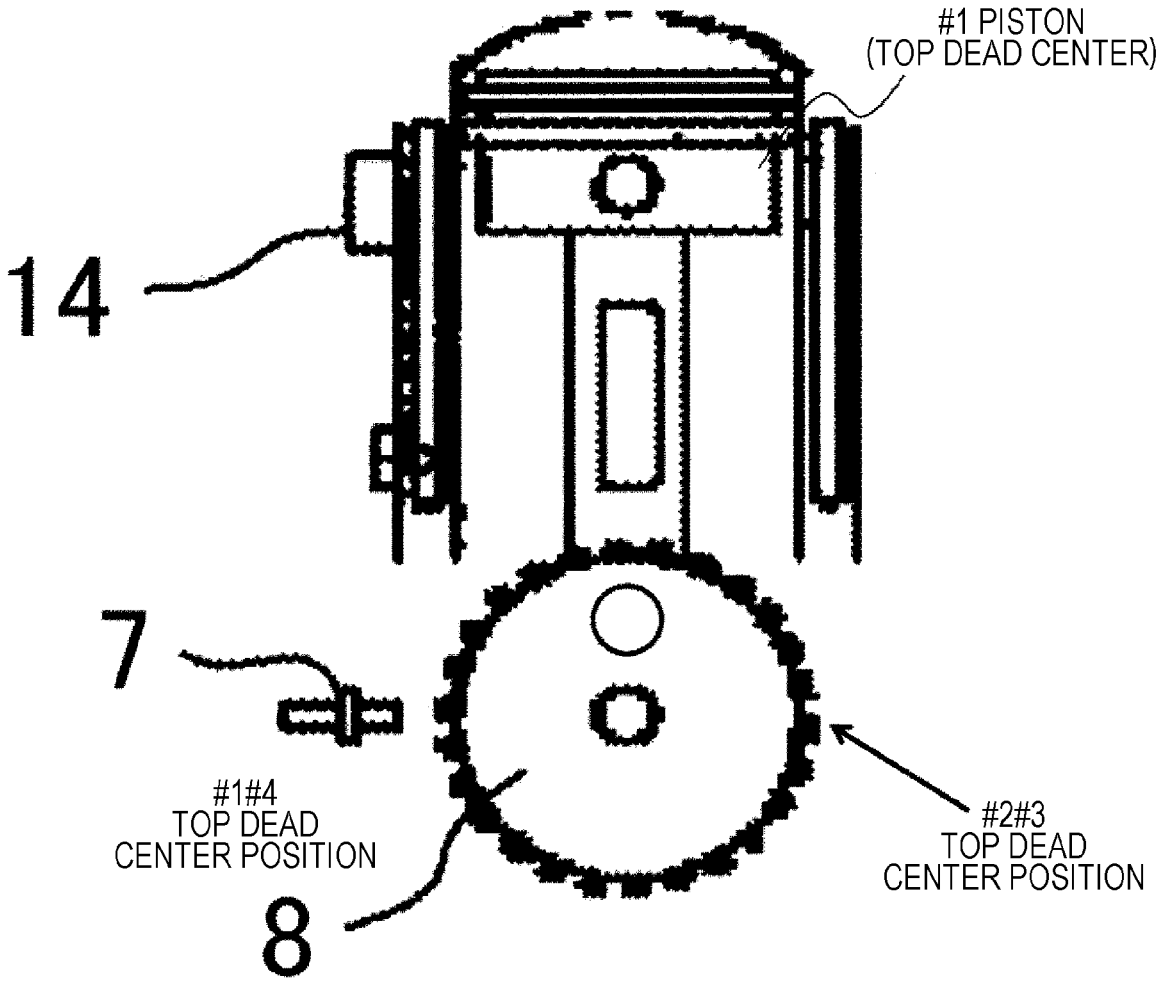
FIG. 4 is a descriptive diagram for describing a detection principle of a crank angle sensor for describing a concept of the present invention.

FIG. 4 is a view of a periphery of the crankshaft partially taken from FIG. 1. In the case of a four-cycle engine, four cylinders burn equally at a crank angle of 720°. A period obtained by equally dividing 720° into four equal parts is a combustion period, and the period is 180°. A period in which the ring gear 8 rotates once includes a combustion period for two cylinders. The ring gear has unevenness at every constant angle (herein, the constant angle is assumed to be 10°). However, in a precise sense, there is a pitch error due to the machining accuracy of the ring gear and the like. The pitch error of the ring gear 8 is constant regardless of the operating condition of the engine.

Figure 5:
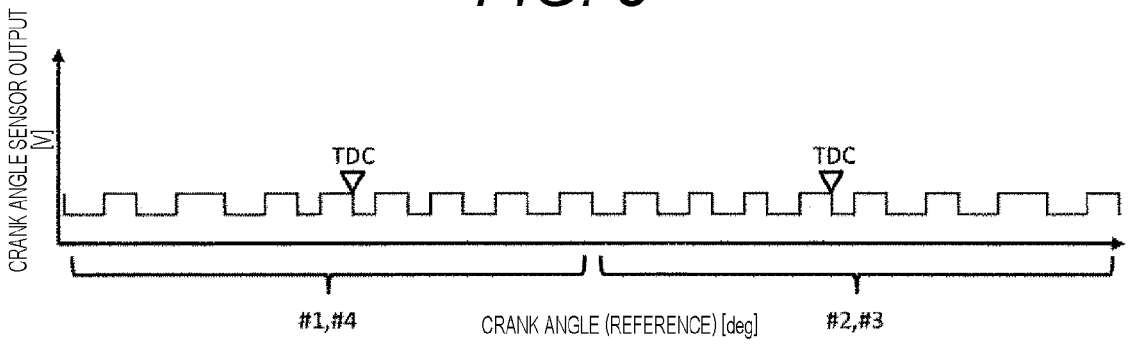
FIG. 5 is a descriptive diagram for describing a pitch error for describing the concept of the present invention.

FIG. 5 illustrates an exemplary output waveform of the crank angle sensor during constant rotation. The horizontal axis represents a reference crank angle for one rotation and the vertical axis represents an output voltage. Ideally, the uneven cycles of the waveform become equal during constant rotation, but in a precise sense, a variation occurs. The first half of the crank angle is the combustion period for one cylinder that is a period for 180°. In each of the first half and a second half, a crank angle top dead center (TDC) is located in the center. Assuming that order of combustion cylinders of this engine is order of #1, #3, #4, and #2, in a case where a period for 180° of the first half is the combustion period of a #1 cylinder and a period for 180° of the second half is the combustion period of a #3 cylinder, and in a case where a period for 180° of the first half is the combustion period of a #4 cylinder, a period for 180° of the second half is the combustion period of a #2 cylinder. The ranges of the ring gear measured in the combustion periods of the #1 cylinder and the #4 cylinder are the same. The ranges of the ring gear measured in the combustion periods of the #2 cylinder and the #3 cylinder are the same. The ranges of the ring gear measured in the combustion periods of the #1 cylinder and the cylinder #4 are different from the ranges of the ring gear measured in the combustion periods of the #2 cylinder and the #3 cylinder.

Figure 6A:
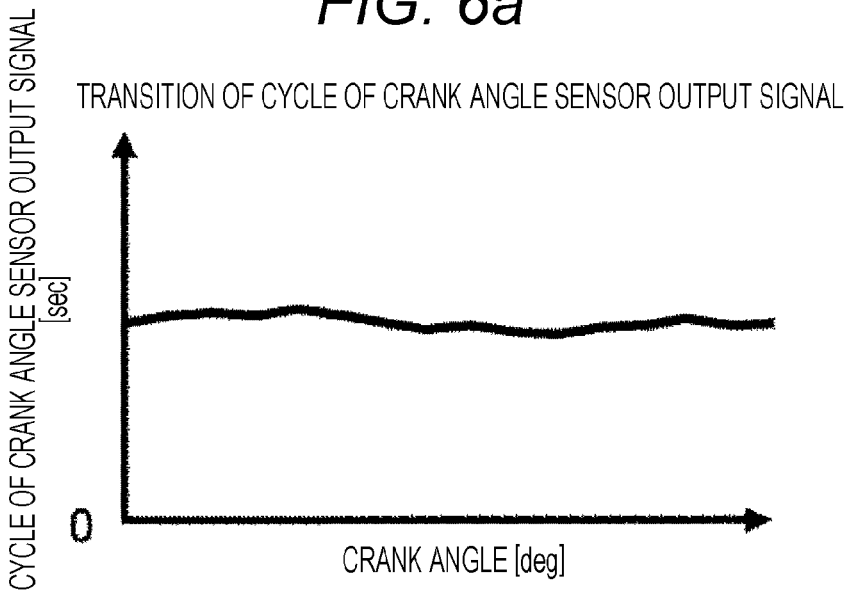
Figure 6B:
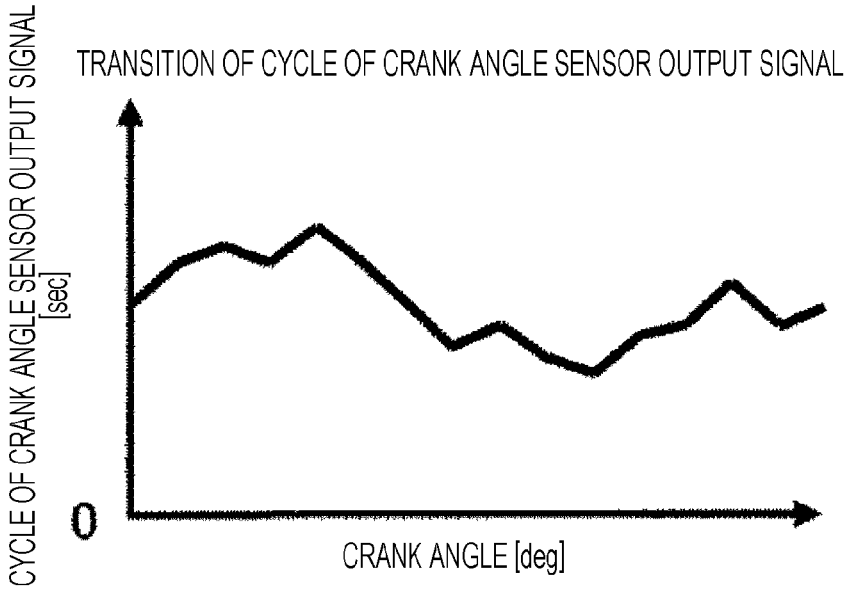

FIG. 6*a* illustrates an example of a waveform during constant rotation. The vertical axis represents the time period of the unevenness of the waveform of the crank angle sensor output signal in FIG. 5. The horizontal axis represents the crank angle for a half rotation (one combustion period) that is detected from the crank angle sensor output signal. The range of the horizontal axis is 180°, during which unevenness is repeated every 10° and therefore 18 points are sampled. In FIG. 6*b*, signals at the 18 points are fluctuating. The cause of the cycle fluctuation during constant rotation is the influence of the pitch error.

FIG. 6*b* illustrates an example of a waveform during engine operation. The vertical axis represents the time period of the unevenness of the waveform of the crank angle sensor output signal in FIG. 5. The horizontal axis represents the crank angle for a half rotation (one combustion period) that is detected from the crank angle sensor output signal. In FIG. 6*b*, signals at the 18 points are fluctuating. The main causes of the cycle fluctuation during engine operation are the combustion pressure, torsional vibration, and the like in addition to pitch error. Since the crankshaft is interlocked with various devices and the engine cannot be strictly rotated at constant rotation, it is impossible to resolve the breakdowns of causes for the cycle fluctuation, including the pitch error, by cause. The cycle fluctuation is influenced by the pitch error and an individual difference of the engine of the ring gear. The torsional vibration is influenced by individual differences of the engine of the crankshaft, but it is generated by combustion pressure. Therefore, if the same engine is operated under the same operating condition, the cycle fluctuation due to the pitch error and the torsional vibration is almost the same. Therefore, in the case of the same engine, the relationship of output fluctuation of the combustion pressure sensor with respect to the cycle fluctuation of the crank angle sensor output signal is reproducible. A relationship between a cyclic signal waveform and a combustion pressure waveform in the combustion period is previously recorded, and if the recorded cyclic signal waveform matches a newly measured cyclic signal waveform, a combustion pressure waveform can be estimated.

FIG. 7 illustrates an example of a waveform during engine operation. The vertical axis represents an output voltage of the combustion pressure 14. The horizontal axis represents the crank angle for a half rotation (one combustion period) that is detected from the crank angle sensor output signal. An actual waveform varies depending on the temperature and amount of air in the combustion chamber, the amount of fuel, the amount of residual gas, and distribution states of the amount of air, the amount of fuel, and the amount of residual gas.

Next, concepts on methods of estimating and detecting the combustion pressure under an actual operating state of the internal combustion engine when the present invention is applied will be described on the basis of FIGS. 8 and 9. Note that in the present embodiment, it is assumed that a combustion pressure detection sensor is mounted. In the following description, an expression "step" is used, but the expression is used to describe concepts of actual combustion pressure estimation and detection methods. By using these concepts, a specific combustion pressure detection method can be implemented by the control apparatus 18, and a combustion pressure detection apparatus can be constructed. Specifically, the combustion pressure detection method is executed by a calculation function based on a control program of the MPU 27 provided in the control apparatus 18, and the combustion pressure detection apparatus is constructed as a calculation function block by the control program of the MPU 27.

Hereinafter, contents to be executed in each step will be described on the basis of FIGS. 8 and 9. FIG. 8 is a flowchart of a procedure for measuring the combustion pressure of the #1 cylinder.

<<Step S102>>

In step S102, an output signal of the combustion pressure sensor 14 is extracted. One measurement period is one combustion period (in the case of an in-line four-cylinder engine, a period for 180° of the crank angle). To grasp the combustion state of the internal combustion engine, a combustion pressure signal A of the internal combustion engine is detected by the combustion pressure sensor 14 of a piezoelectric type provided at an appropriate position of the internal combustion engine 1. The combustion pressure sensor 14 is capable of detecting vibration over a wide frequency band, and the output signal of the combustion pressure sensor 14 is used for calculation of the control apparatus 18. Then, the output signal of the combustion pressure sensor 14 obtained in this way is taken into an analog input circuit of the control apparatus 18, and the processing described below is executed by the MPU 27.

<<Step S103>>

In step S103, an output signal of the crank angle sensor 7 is first extracted by the digital input unit 23 in the control apparatus 18. One measurement period is one combustion period (in the case of an in-line four-cylinder engine, a period for 180° of the crank angle). A reciprocal type frequency counter measures a cycle B at timing when the extracted output signal of the crank angle sensor 7 exceeds a predetermined threshold value. Herein, in a case where the pitch of the ring gear 8 is 10°, the number of measurements is 18 points.

<<Step S104>>

In step S104, the cycle B of the crank angle sensor output signal measured in step S103 is collated with a cycle C of a plurality of crank angle sensor output signals included in the prerecorded relationship. In the relationship, the cycle C of the plurality of crank angle sensor output signals and an output signal D of the combustion pressure sensor 14 measured simultaneously are recorded in pairs. By the collation, a cycle C' of the crank angle sensor output signal that is the closest in the relationship is selected and an output signal D' of the combustion pressure sensor 14 measured simultaneously with C' is extracted from the relationship.

To describe more specifically about this step S104, the internal combustion engine control apparatus 18 according to the present embodiment stores, in the RAM 25 (memory), a plurality of relationships between a cycle [sec] of the crank angle sensor output signal with respect to a crank angle [deg] as illustrated in FIG. 6 and the output signal D of the combustion pressure sensor 14 measured simultaneously with the cycle [sec] as illustrated in FIG. 7, as learning databases, according to the engine speed or torque.

Then, the MPU (that may be referred to as a microprocessor unit or just a processor) collates an actually detected crank angle sensor signal with the above-described relationship stored in the RAM 25 (memory), selects a relationship of the cycle [sec] of the crank angle sensor output signal to the crank angle [deg] that is the closest relationship, and estimates and outputs a corresponding output signal D of the combustion pressure sensor 14 as the in-cylinder pressure.

At the time of this collation, the MPU (microprocessor unit) 27 resolves the actually measured angular velocity of the crankshaft into a frequency component. Then, a frequency component closest to the resolved frequency component among a frequency component group stored in the learning data is extracted. Then, the MPU (microprocessor unit) 27 estimates and obtains the in-cylinder pressure associated with the extracted closest frequency component as the actual in-cylinder pressure. Herein, it has been described that collation is performed after performing frequency resolution. However, the present embodiment is not limited to this method, and it is also possible to perform collation by simply comparing waveforms.

Note that in a case where the pressure sensor 14 is originally provided in the cylinder, the MPU (microprocessor unit) 27 may use the estimated in-cylinder pressure to perform vehicle control only in a case where a failure of the pressure sensor 14 is detected.

In a case where the internal combustion engine includes a plurality of cylinders #1 to 4, for example, the reference pressure sensor 14 is provided in one cylinder #2. Then, the internal combustion engine control apparatus 18 according to the present embodiment creates learning data of the frequency component group of the angular velocity of the crankshaft that corresponds to the in-cylinder pressure of the cylinder according to an engine speed or torque in a reference cylinder (for example, cylinder #2) including the reference pressure sensor and stores the learning data in the RAM 25 (memory). Then, to estimate the in-cylinder pressure of a cylinder (for example, #1) not provided with the pressure sensor 14 during steady operation, the MPU (microprocessor unit) 27 corrects the measured crank angle sensor signal so as to correspond to the cylinder #2 on the basis of the above relationship. In addition, the MPU (microprocessor unit) 27 resolves a corrected angular velocity of the crankshaft into a frequency component. Then, a frequency component closest to the resolved frequency component among a frequency component group stored in the learning data is extracted. Then, the MPU (microprocessor unit) 27 estimates and obtains the in-cylinder pressure associated with the extracted closest frequency component as the actual in-cylinder pressure. Note that in a case where the pressure sensor 14 is originally provided in the #2 cylinder, the MPU (microprocessor unit) 27 may use the estimated in-cylinder pressure to perform vehicle control only in a case where a failure of the pressure sensor 14 is detected.

<<Step S105>>

In step S105, to compare the combustion pressure signal A measured in step S102 and the combustion pressure signal D' estimated in step S104, deviations of both the combustion pressure signals are calculated.

<<Step S106>>

In step S106, the deviation calculated in step S105 is compared with a predetermined specified value, and conditional branching processing is performed. In a case where the deviation calculated in step S105 is equal to or smaller than the deviation calculated in step S105, it is determined that the combustion pressure sensor is operating normally, and the process proceeds to step S107. In a case where the deviation calculated in step S105 is larger than the deviation calculated in step S105, it is determined that the combustion pressure sensor is operating abnormally, and the process proceeds to step S110.

<<Step S107>>

In step S107, the combustion pressure signal A measured in step S102 and the cycle B measured in step S103 are additionally recorded as a pair of pieces of information in the relationship.

<<Step S108>>

In step S108, the combustion pressure signal A measured in step S102 is output.

<<Step S110>>

In step S110, the combustion pressure signal D' estimated in step S104 is output.

According to the procedures described above, in a case where the combustion pressure sensor malfunctions, abnormality is detected and an estimated value is output instead of the measured value. As a result, the quality of combustion control is maintained.

The procedures of steps S101 to S111 are applied to each cylinder, and the recording of and collation with the relationship are performed for each cylinder. However, in a multi-cylinder engine, estimation accuracy can be improved by using the relationships of other cylinders in some cases and such case will be described below. When the number of recorded relationships is small, divergence in the collation in step S104 becomes large, and the estimation accuracy of the combustion pressure decreases. However, when the number of recorded relationships is large, the number of times of collations increases. Therefore, the calculation capacity of the control apparatus 18 is consumed. Thus, the required number of relationships to be recorded is set for each engine model. Therefore, after the number of recorded relationships reaches the required number of relationships to be recorded, it is necessary to prevent the number of recorded relationships from increasing further. To do so, there are methods such as stopping new records or replacing new records with old records. In a case where a change in the relationship over time is observed due to wear of the engine and the like, the method of replacing new records with old records is more effective. However, in a case where the combustion pressure sensor fails before the number of recorded relationships reaches the required number of relationships to be recorded and output abnormality continues without self-recovering, the additional recording of the relationship is stopped. In this state, since the number of recorded relationships (hereinafter referred to as the number of relationship records) does not reach the required number of relationships to be recorded (hereinafter referred to as the specified value), the estimation accuracy of the combustion pressure is not improved. In this case, since the estimation accuracy can be improved by using the relationships of other cylinders, this procedure is illustrated in FIG. 9. FIG. 9 depicts the procedure for measuring the combustion pressure of the #1 cylinder and is FIG. 8 with addition of some procedures. The added procedures are steps S204 to S209.

<<Step S204>>

In step S204, the number of recorded relationships of the #1 cylinder (hereinafter referred to as the number of relationship records) is compared with the required number of relationships to be recorded (hereinafter referred to as the specified value). In a case where the number of relationship records is less than the specified value, the process proceeds to step S205. In a case where the number of relationship records is not less than the specified value, the process proceeds to step S210.

<<Step S205>>

In step S205, the number of recorded relationships of the #4 cylinder (hereinafter referred to as the number of relationship records) is compared with the required number of relationships to be recorded (hereinafter referred to as the specified value). In a case where the number of relationship records is less than the specified value, the process proceeds to step S206. In a case where the number of relationship records is not less than the specified value, the process proceeds to step S211.

<<Step S206>>

In step S206, the number of recorded relationships of the #4 cylinder (hereinafter, the number of relationship records) is compared with the required number of relationships to be recorded (hereinafter referred to as specified values). In a case where the number of relationship records is less than the specified value, the process proceeds to step S207. In a case where the number of relationship records is not less than the specified value, the process proceeds to step S208.

<<Step S207>>

In step S207, the number of recorded relationships of the #4 cylinder (hereinafter referred to as the number of relationship records) is compared with the required number of relationships to be recorded (hereinafter referred to as the specified value). In a case where the number of relationship records is less than the specified value, the process proceeds to step S221. In a case where the number of relationship records is not less than the specified value, the process proceeds to step S209.

<<Step S208>>

In step 208, the relative correction of the pitch error is performed. For the #1 cylinder and the #2 cylinder, since the range of use of the ring gear in the combustion period is the same, and the pitch error is relatively equal, correction processing is necessary. To measure a deviation between the pitch of the ring gear used in the combustion period of the #1 cylinder and the pitch of the ring gear used in the combustion period of the #2 cylinder, the cycle of the output signal of the crank angle sensor is measured in the operating state in which rotation fluctuation is suppressed as much as possible. As the operating state in which the rotation fluctuation is suppressed, there is a case where the combustion is not performed due to fuel cut-off at the time of vehicle deceleration. In addition, it is also conceivable a case where vertical motion is small and load fluctuation from a road surface to the crankshaft is small at the vehicle acceleration sensor. By obtaining a ratio between the cycle of the output signal of the crank angle sensor of the #1 cylinder and the cycle of the output signal of the crank angle sensor of the #2 cylinder that are measured in the operating state in which the rotation fluctuation is suppressed as much as possible, the relative correction of the pitch error is possible.

By multiplying the cycle of the output signal of the measured #1 cylinder crank angle sensor by the obtained cycle ratio, relative correction is made to the cycle of the output signal of the #2 cylinder crank angle sensor. By collating the cyclic signal after the relative correction with the relationship of the #2 cylinder, the combustion pressure of the #1 cylinder is estimated.

<<Step S208>>

In step 208, the relative correction of the pitch error is performed. For the #1 cylinder and the #3 cylinder, the use range of the ring gear in the combustion period is the same, and the pitch error is relatively equal. Therefore, correction processing is necessary. To measure a deviation between the pitch of the ring gear used in the combustion period of the #1 cylinder and the pitch of the ring gear used in the combustion period of the #3 cylinder, the cycle of the output signal of the crank angle sensor is measured in the operating state in which the rotation fluctuation is suppressed as much as possible. As the operating state in which the rotation fluctuation is suppressed, there is a case where the combustion is not performed due to fuel cut-off at the time of vehicle deceleration. In addition, it is also conceivable a case where vertical motion is small and load fluctuation from a road surface to the crankshaft is small at the vehicle acceleration sensor. By obtaining a ratio between the cycle of the output signal of the crank angle sensor of #1 cylinder and the cycle of the output signal of the crank angle sensor of #3 cylinder that are measured in the operating state in which the rotation fluctuation is suppressed as much as possible, the relative correction of the pitch error is possible. By multiplying the cycle of the output signal of the measured #1 cylinder crank angle sensor by the obtained cycle ratio (relationship a), relative correction is made to the cycle of the output signal of the #3 cylinder crank angle sensor. By collating the cyclic signal after the relative correction with the relationship of the #3 cylinder, the combustion pressure of the #1 cylinder is estimated.

<<Step S210>>

Since step S210 is a method of estimating the fuel pressure similar to the method in step S104 of FIG. 8, description thereof will be omitted.

<<Step S211>>

Step S210 is similar to step S104 of FIG. 8. For the #1 cylinder and the #4 cylinder, since the range of use of the ring gear is the same in the combustion period, the correction processing is unnecessary because the pitch error is relatively equal.

<<Step S212>>

Step S212 is a fuel pressure estimation method similar to the method in step S104 of FIG. 8. That is, the internal combustion engine control apparatus 18 stores, in the RAM 25 (memory), regarding to the #1 cylinder, a plurality of relationships between the cycle [sec] of the crank angle sensor output signal with respect to the crank angle [deg] as illustrated in FIG. 6 and the output signal D of the combustion pressure sensor 14 measured simultaneously with the cycle [sec] as illustrated in FIG. 7, as learning databases, according to the engine speed or torque.

Then, the MPU (that may be referred to as a microprocessor unit or just a processor) collates an actually detected crank angle sensor signal with the above-described relationship stored in the RAM 25 (memory), selects a relationship of the cycle [sec] of the crank angle sensor output signal to the crank angle [deg] that is the closest relationship, and estimates and outputs a corresponding output signal D of the combustion pressure sensor 14 as the in-cylinder pressure.

In a case where the cylinder pressure of the cylinder #2 other than the predetermined cylinder #1 is estimated, the MPU (microprocessor unit) 27 corrects the measured crank angle sensor signal so as to correspond to the reference cylinder #1, as described above. Then, the MPU (microprocessor unit) 27 obtains the in-cylinder pressure of the cylinder #1 by collating the corrected crank angle sensor signal with the relationship between the crank sensor signal and the in-cylinder pressure of a predetermined cylinder that is stored in the RAM 25 (memory) and estimates and outputs the obtained in-cylinder pressure of the cylinder #1 as the in-cylinder pressure of the cylinder #2.

<<Step S213>>

Step S213 is similar to step S104 of FIG. 8. Other procedures are similar to those in FIG. 8. For order of other cylinders in the case of using the relationship of another cylinder, priority is given to another cylinder that does not need the relative correction of the pitch error Next, priority is given to another cylinder, the distance of which is close. For example, in the in-line four-cylinder engine illustrated in FIG. 3, in a case where the combustion pressure of cylinder #1 is estimated, in a case where the number of relationship records of #1 is less than the specified value, the relationship of #3 cylinder is used. In a case where the number of relationship records of #3 cylinder is less than the specified value, the relationship of the #2 cylinder that is close to the

#1 cylinder in terms of distance is used after being subjected to the relative correction. In a case where the number of relationship records of the #2 cylinder is less than the specified value, the relationship of #4 cylinder is used after being subjected to the relative correction.

In the above-described procedure, the combustion pressure sensor is mounted for each cylinder, and even in a case where the combustion pressure sensor fails early, the combustion pressure can be estimated by using the histories of the combustion states of other cylinders, whereby redundancy can be provided. In a case where the number of relationship records reaches the specified value, the estimated value of the combustion pressure can continue to be output even if all the combustion pressure sensors fail. In addition, when the durability of the combustion pressure sensor improves in the future, if the number of the combustion pressure sensors to be mounted is reduced and the combustion pressure of a non-mounted cylinder is estimated, a cost can be reduced.

REFERENCE SIGNS LIST

2 air cleaner
5 throttle valve
6 flow detection device
7 rotational speed detecting means
8 plate or ring gear
9 fuel tank
10 fuel pump
11 pressure regulator
12 fuel pipe
13 fuel injector
15 three-way catalyst
16 air-fuel ratio sensor
17 O2 sensor
18 internal combustion engine control apparatus
19 ignition device
40 fuel injection control block
41 ignition control block
48 combustion pressure estimation block

The invention claimed is:

1. An internal combustion engine control apparatus for combustion pressure detection, comprising:
- a combustion pressure sensor configured to couple to a first cylinder and to output a combustion pressure signal;
- a crank angle sensor for a crankshaft, the crank angle sensor configured to output a crank signal;
- a memory; and
- a processor communicatively coupled to each of the memory, the combustion pressure sensor, and the crank angle sensor, the processor configured to:
  - at a first time:
    - detect a first crank signal,
    - detect a combustion pressure signal,
    - calculate a relationship between the first crank signal and the combustion pressure signal, and
    - store, in the memory, the relationship,
  - at a subsequent time, detect a subsequent crank signal,
  - obtain in-cylinder pressure of the first cylinder by collating the subsequent crank signal the relationship.

2. The internal combustion engine control apparatus according to claim 1,
- wherein
- the crank angle sensor is for detecting angular velocity of the crankshaft, and the crank signal reflects an angular velocity; and
- the processor is configured to:
  - over a first time period:
    - detect a plurality of first crank signals and a corresponding plurality of combustion pressure signals according to a plurality of engine speed or torque states,
    - resolve each of the plurality of crank signals into a corresponding frequency component of the crank shaft,
    - calculate a plurality of relationships between the crank signals and the corresponding combustion pressure signals, and
    - record, to the memory, the frequency components and the plurality of relationships as a learning database, and
  - at a second time after the first time period:
    - detect a second crank signal,
    - resolve the second crank signal into a second frequency component,
    - select a reference frequency component from the learning database, wherein the reference frequency component is closest to the second frequency component, and
    - obtain the in-cylinder pressure based on a relationship of the plurality of relationships in the learning database that corresponds to the selected reference frequency component.

3. The internal combustion engine control apparatus according to claim 1,
- wherein the processor is configured to:
  - detect a second crank signal,
  - correct the second crank signal to correspond to a second cylinder, and
  - obtain the in-cylinder pressure of the second cylinder by collating the corrected second crank signal with the relationship.

4. An internal combustion engine control apparatus that controls an internal combustion engine including a plurality of cylinders, comprising:
- an internal combustion engine including a plurality of cylinders and a crankshaft;
- a first combustion pressure sensor operatively coupled to a first cylinder of the plurality of cylinders and configured to produce a combustion pressure signal;
- a crank angle sensor for a crankshaft, the crank angle sensor configured to produce a crank signal;
- a memory; and
- a processor communicatively coupled to the memory, the processor configured to:
  - determine, at a first time, a relationship between the first crank signal and the combustion pressure signal,
  - store the relationship in the memory, and
  - on a condition that the first combustion pressure sensor fails;
    - detect a crank signal,
    - correct the detected crank signal to correspond to the first cylinder, and
    - obtain an in-cylinder pressure of the first cylinder by collating the corrected crank signal with the relationship.

5. The internal combustion engine control apparatus according to claim 4, wherein the processor is configured to:

over a first time period:

detect, according to a plurality of engine speed or torque states, a plurality of first crank signals and a corresponding plurality of combustion pressure signals from the first combustion pressure sensor, resolve each of the plurality of crank signals into a corresponding frequency component of the crank shaft, calculate a plurality of relationships between the crank signals and the corresponding combustion pressure signals, and record, to the memory, the frequency components and the plurality of relationships as a learning database, and at a second time after the first time period:

detect a second crank signal, resolve the second crank signal into a second frequency component, select a reference frequency component from the learning database, wherein the reference frequency component is closest to the second frequency component, and obtain the in-cylinder pressure of a second cylinder based on a relationship of the plurality of relationships in the learning database that corresponds to the selected reference frequency component.

6. The internal combustion engine control apparatus according to claim 4, wherein the processor is configured to control the internal combustion engine based on the obtained in-cylinder pressure of the cylinder by adjusting at least one of a fuel injection amount, a fuel injection timing, or an ignition timing.

* * * * *